United States Patent [19]

LeBlanc

[11] Patent Number: 4,660,704

[45] Date of Patent: Apr. 28, 1987

[54] WEAPON SYSTEM

[75] Inventor: Richard S. LeBlanc, Mt. Clemens, Mich.

[73] Assignee: General Motors Corporation, Detroit, Mich.

[21] Appl. No.: 761,479

[22] Filed: Aug. 2, 1985

Related U.S. Application Data

[60] Division of Ser. No. 680,799, Dec. 13, 1984, Pat. No. 4,574,683, which is a continuation of Ser. No. 437,853, Oct. 29, 1982, abandoned.

[51] Int. Cl.[4] ..... B65G 11/10; B65G 11/00

[52] U.S. Cl. ..... 193/38; 89/33.14; 193/25 AC

[58] Field of Search ..... 193/25 AC, 2 R, 38, 193/41, 46, 25 FT; 89/33.4, 33.1, 34, 33.14, 35 R

[56] References Cited

U.S. PATENT DOCUMENTS

| | | | |
|---|---|---|---|
| 2,305,667 | 12/1942 | Brentnall | 89/33.14 X |
| 2,363,219 | 11/1944 | Adamson | 89/33.14 X |
| 2,794,369 | 6/1957 | Darsie | 89/35.02 |
| 4,338,851 | 7/1982 | Bremer et al. | 89/33.14 |

FOREIGN PATENT DOCUMENTS

| | | | |
|---|---|---|---|
| 1147807 | 11/1957 | France | 89/33.14 |
| 538808 | 8/1941 | United Kingdom | 193/25 AC |
| 582509 | 11/1946 | United Kingdom | 89/33.14 |

*Primary Examiner*—Jeffrey V. Nase
*Attorney, Agent, or Firm*—Edward J. Biskup

[57] ABSTRACT

A link guide chutes for a weapon system including a main gun using link fed ammunition and a co-axially mounted machine gun mounted in a turret rotatably positionable in an armored vehicle. The spent links for the main gun and the spent machine gun links and brass are ejected through the trunnion bearing on which the rotor for the main gun rotates and into a compartment which communicates with the exterior of the vehicle. The link guide chutes for the main gun, which can be a dual fed 25 millimeter gun, include guide strips for guiding the tab members of the links through the chute channels and thereby preventing jamming.

1 Claim, 3 Drawing Figures

WEAPON SYSTEM

This is a division of application Ser. No. 680,799 filed on Dec. 13, 1984 U.S. Pat. No. 4,574,683 which is a continuation of application Ser. No. 437,853 filed on Oct. 29, 1982, now abandoned.

FIELD OF THE INVENTION

The present invention relates to a weapon system for an armored vehicle turret. The invention further relates to ammunition storage boxes, feeding means and spent link ejecting chutes for the ammunition for such a system.

BACKGROUND OF THE INVENTION

In the prior art, there have been developed and used various types of armored vehicles having rotatable turrets with guns mounted thereon. Problems have developed though in that the ammunition has not been stored in such a manner that it could freely feed to the main gun without getting bunched and jammed. Further, after the guns had been fired and the brass ejected, no suitable means had been developed for moving the spent links in a free flowing manner away from the gun to a discharge means. This is particularly important since when the ejected links jam the gun quits firing.

A serious previously-unsolved problem was caused by the link eject means. The links have guide tabs, as more fully described later, which travel in channels in the arcuate shaped link eject chutes. The sharp edges of the guide tabs would cut into the channels as the links traveled around the curved portions thereby jamming the links in the eject chutes and shutting the gun down.

OBJECTS OF THE INVENTION

Accordingly, it is the principal object of the present invention to provide an improved weapon system for a rotatable turret having an improved link ejection chute which allows the ejection links to flow freely out of the gun without being jammed.

Other objects and advantages of the present invention will become more apparent to those persons having ordinary skill in the art from the following description taken in conjunction with the accompanying drawings.

THE DRAWINGS

DESCRIPTION OF THE PREFERRED EMBODIMENT

Figure 1:
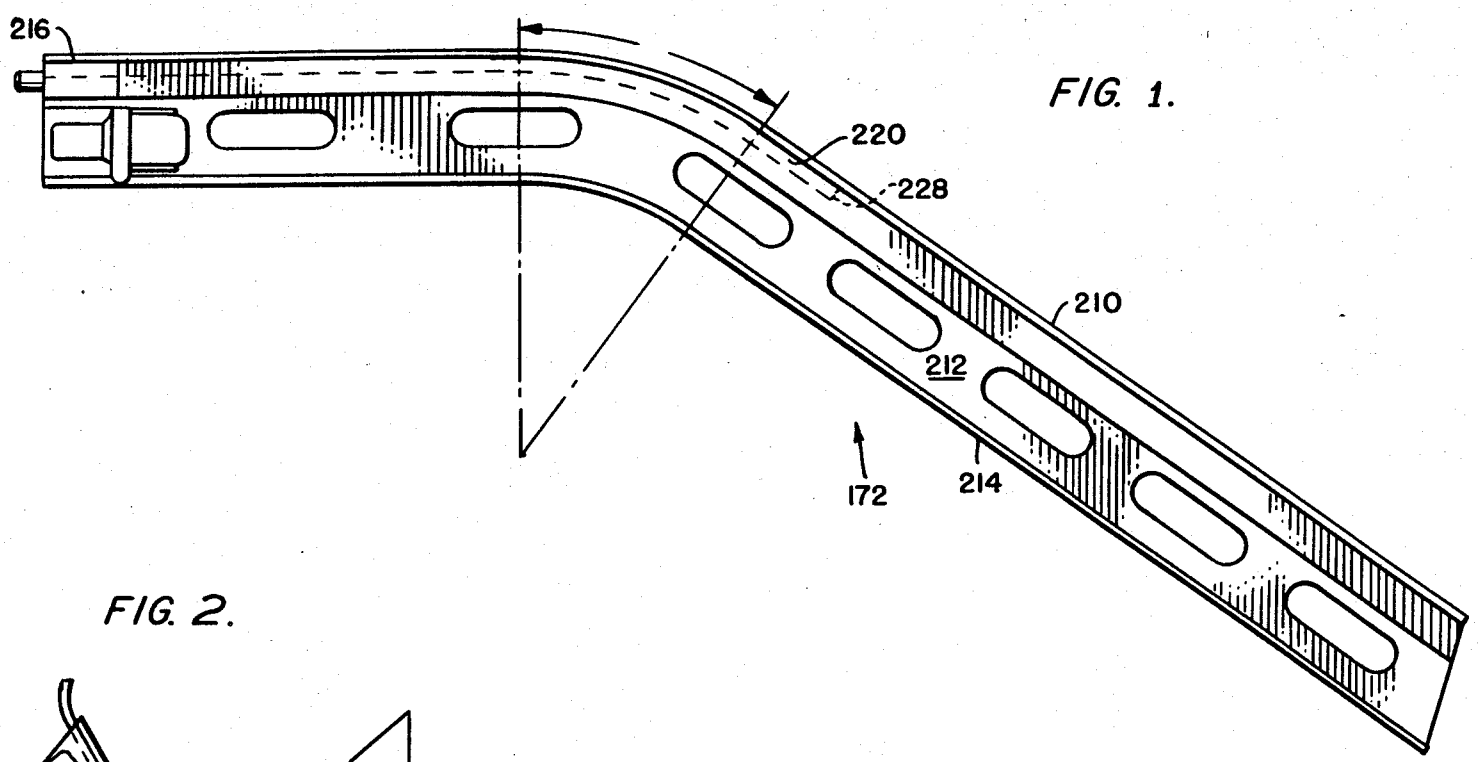
FIG. 1 is a side elevational view of an upper ammunition discharge chute according to the present invention.

Referring to the drawings, there is illustrated an embodiment of the present invention. Generally, this embodiment is intended to be incorporated into the turret of an armored vehicle that is shown and described in U.S. Pat. No. 4,574,683, issued on Mar. 11, 1986 and assigned to the assignee of this invention. In order to understand the environment in which the present invention is located, the descriptive subject matter set forth in the aforementioned U.S. Pat. No. 4,574,683 is hereby incorporated by reference, and it is suggested that the specification of that patent, and particularly the portion thereof relating to the main gun, be read in conjunction with this specification.

Figure 2:
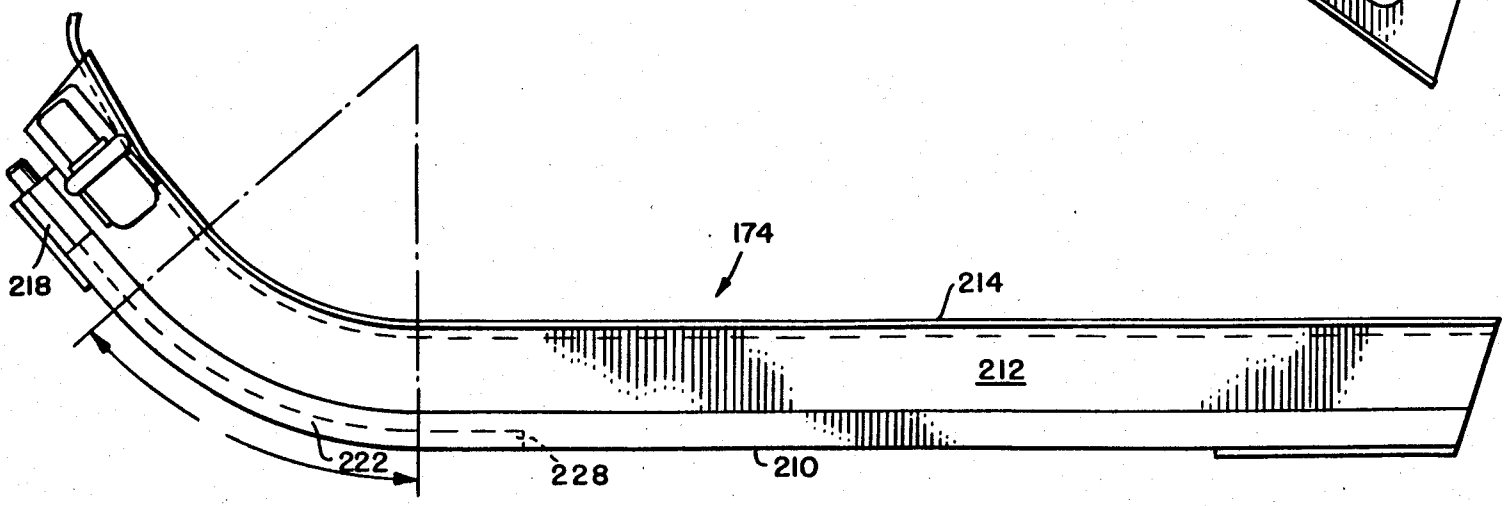
FIG. 2 is a side elevational view of a lower ammunition discharge chute according to the present invention.
Figure 3:
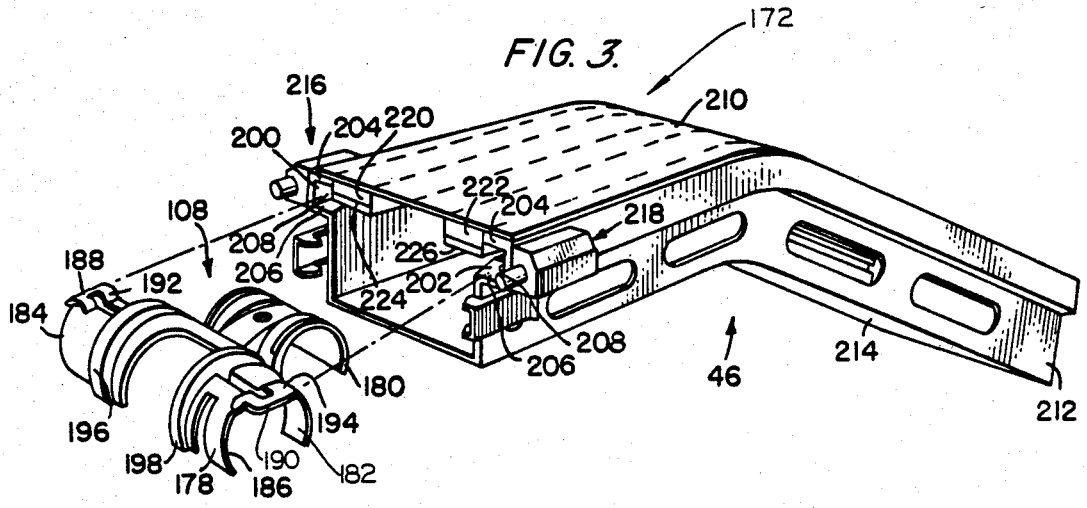
FIG. 3 is a perspective view showing the ammunition discharge chutes of FIGS. 1 and 2 combined to provide the guide chute of the present invention.

As seen in FIGS. 1–3, link ejection chutes 46 are provided which eject still-connected links 108 from the main gun 38 to compartment 48 shown in the aforementioned patent. The brass having been ejected forward out of brass opening 168, best shown in FIG. 7 of this aforementioned patent, in the main gun 38. Two ejection chutes are provided for the present dual feed gun 38—an upper armor piercing link discharge chute 172 as shown in isolation in FIGS. 1 and 3, and a lower high explosive link discharge chute as shown in isolation at 174 in FIG. 2. As previously mentioned and especially with the M242 25 millimeter gun, the link chutes have proven to be the Achilles heel for the entire weapon system. This is because the links 108 tended to jam in the chutes thereby shutting the gun down. Referring to FIG. 3 is it seen that each link 108 has a cylindrical portion 178 and a smaller cylindrical connection portion 180 attached thereto. The cylindrical portion 178 has a cylindrical surface 182 and ends 184 and 186. Guide tabs 188 and 190 are attached to ends 184 and 186 respectively. Not only do these tabs protrude from the ends but they also have raised portions 192 and 194 respectively raised from cylindrical surface 182 and generally adjacent ends 184 and 186 respectively. Ribs 196 and 198 also protrude from cylindrical surface 182. Guide tabs 188 and 190 are provided to ride in channels 200 and 202 of the guide chute, as best shown in FIG. 3. These channels 200 and 202 are generally U-shaped and have outer surfaces 204, inner surfaces 206 and end surfaces 208. The guide tabs have rough or cutting edges which heretofore have tended to dig into channels 200 and 202 when the links 108 round a bend in the link chutes, thereby jamming the links 108 in the chutes. Ideally, the tabs would not become jammed in the channels 202 if the link chutes were straight but due to the design configurations of this turret mounted weapon systems it is necessary that the chutes 46 be curved. The chutes 46 also have upper skins 210, side panels 212, and lower skins 214. The upper and lower skins 210 and 214 and side panels 212 define a generally rectangular passageway for the links 108, as shown in FIG. 11. Attachment clips 216 and 218 are mounted to the sides of channels 200 and 202 respectively and are attached to corresponding female members on the main gun 38.

The present invention provides for guide strips 220 and 222 secured adjacent outer surface 204 and to the inner surface of the upper skin 210. These guide strips 220 and 222 have a width greater than the outer surfaces 204 whereby the inner surfaces, as shown at 224 and 226, of guide strips 220 and 222 extend further toward the center of the associated chute than do outer surfaces 204. Inner guide strip surfaces 224 and 226 engage raised portions 192 and 194, respectively, of the tabs 188 and 190 and thereby prevent the edges of the tabs 188 and 190 from engaging and jamming into upper channel surface 204. The links 108 may then flow freely through the chutes 172 and 174 into the compartment 48. The guide strips 224 and 226 need not extend the entire length of the chutes but can end once the links 108 have rounded the arc portion as shown at 228 in FIGS. 9 and 10. Using the same general principal for guiding the links 108 in the chutes 172 and 174, the guide strips 224 and 226 could alternatively be configured and positioned so that they engage the rib portions 196 and 198.

From the foregoing detailed description, it will be evident that there are a number of changes, adaptations and modifications of the present invention which come within the province of those skilled in the art. However, it is intended that all such variations not departing from the spirit of the invention be considered as within the scope thereof and as limited solely by the appended claims.

I claim:

1. A guide chute for guiding ammunition links after the ammunition rounds have been fired and the brass ejected therefrom, each link having a generally cylindrical shape, including an outer cylinder surface and two opposing ends, opposing guide tab members protruding longitudinally from the ends and having raised portions raised from the cylindrical surface, and a connecting means for removably connecting adjacent links positioned so that their longitudinal axis are generally parallel, said guide chute having a generally rectangular passageway for said links defined by an upper skin, a lower skin and a pair of laterally spaced side panels, a pair of spaced opposed elongated U-shaped channels formed in said pair of side panels in which the tab members slide, said pair of elongated U-shaped channels defining an elongated arc shape having a center of curvature, each of said pair of U-shaped channels being defined by a vertical end surface and upper and lower inner surfaces, guide strip means associated with said pair of U-shaped channels and having a contact surface engaging the raised portions of the guide tab members when the tab members are positioned in said channels and guiding the tab members toward said center of curvature, said guide strip means comprising a pair of arcuate shaped members depending from and attached to said upper skin so that the contact surface of each of said guide strip contacting the raised portions of the links is positioned below the plane of upper skin and closer to the center of the guide chute than is the upper inner surface of said associated U-shaped channel.

* * * * *